United States Patent [19]

Goldfarb

[11] 4,421,415

[45] Dec. 20, 1983

[54] COIN CLOCK

[76] Inventor: Adolph E. Goldfarb, 4614 Monarca Dr., Tarzana, Calif. 91356

[21] Appl. No.: 347,941

[22] Filed: Feb. 11, 1982

[51] Int. Cl.[3] ..... G04B 19/00

[52] U.S. Cl. ..... 368/62; 368/223

[58] Field of Search ..... 368/62, 76, 93, 220, 368/223, 228, 276

[56] References Cited

U.S. PATENT DOCUMENTS

| | | | |
|---|---|---|---|
| 4,077,198 | 3/1978 | Mayenschein | 368/223 |
| 4,280,211 | 7/1981 | Mayenschein | 368/76 |
| 4,370,064 | 1/1983 | Hicks et al. | 368/93 |

*Primary Examiner*—Vit W. Miska

*Attorney, Agent, or Firm*—Romney, Golant, Martin, Disner & Ashen

[57] ABSTRACT

A clock mechanism displays the time by accumulations of counting tokens visibly within generally vertical but zigzag-shaped channels. A synchronously driven belt carries projecting pins which push the tokens along a path from an enclosure near the bottom of the mechanism to positions above the channels, whence the tokens drop into the channels that are not full. When a particular channel is full, a token bypasses that channel and caused tokens already within the channel to be released for return to the enclosure.

Time indicia disposed in front of the channels and the push-path identify the times represented by the various possible accumulations of tokens in the channels and the positions of tokens along the push-path. The indicia are adatped to be relatively inconspicuous when not backed up by tokens, and to be made relatively conspicuous when they are backed up by tokens.

Dynamic feed means such as a rotating sectored wheel feed the tokens one at a time into position for takeup by the pushpins on the belt.

The tokens may be adapted to hold and carry coins visibly while in use.

20 Claims, 17 Drawing Figures

COIN CLOCK

BACKGROUND

1. Field of the Invention

This invention relates generally to novelty clocks, and more particularly to clocks which display the time by changing patterns of discrete, independently movable mechanical elements that are not affixed to the mechanism. I refer to such elements as "counting tokens."

2. Prior Art

The most closely related prior device of which I am aware is an electric "ball clock." That device consists of three shallowly inclined chutes in which steel balls accumulate, a system of shallowly inclined feed chutes for delivering the balls to the accumulator chutes, a bottom container for storage of balls that have been discharged from the accumulator chutes, and a motor-driven elevator for delivering one ball per minute from the bottom container to the top of the feed-chute system.

In the ball clock the three chutes are arrayed generally one above the other. The lowest chute accepts up to twelve balls, each ball representing one hour. The middle chute accepts up to eleven balls, each ball representing five minutes, and the top chute accepts up to four balls, each ball representing one minute.

The balls supplied to the top of the feed-chute system are directed to the top chute (the "minute chute"), where they accumulate until the chute is full—that is, until it contains four balls. The next ball to arrive then causes the minute chute to tilt like a see-saw, spilling the previously contained four balls into a secondary chute system that returns them to the bottom container, while the fifth ball (that caused the tilting action) is returned to the feed-chute system for delivery to the center chute (the "five-minute chute").

The latter functions in a manner similar to that of the top chute, accepting the balls that are rejected by the minute chute (that is, every fifth ball supplied by the elevator)—until eleven balls have been accumulated, representing fifty-five minutes. The next "fifth ball" then tilts the five-minute chute, spilling the accumulated balls into the secondary return-chute system for return to the bottom container, while the rejected "fifth ball" or "hour ball" traverses the next section of the feed-chute system to the lowest chute (the "hour chute").

The hour chute functions in a manner similar to the first two, accumulating up to twelve balls. When a thirteenth ball arrives, the hour chute tilts to spill the twelve accumulated balls into the return-chute system—but in this case the thirteenth ball itself is not rejected but eventually rolls into the hour chute to represent "one o'clock."

The depth of each accumulator chute in the ball clock is roughly half the diameter of the balls, and the chutes are opaque. Displayed along the side of each chute that faces the user are numeric indicia that identify the number of minutes (up to four), five-minute counts, and hours represented by balls in the chutes. These indicia are clearly visible at all times. To read the time it is thus necessary to look to see what numeric indicium appears on the side of the chute below each most-recently-arrived ball, add the values thus identified for the top two chutes to obtain the number of minutes, and mentally invert the order of the minute total thus obtained relative to the hour indicium to obtain the time in the conventional (first hours, then minutes) format.

There is no indication of the number of seconds elapsed since the last minute ball was delivered, although the number of seconds can be very roughly inferred from the position of the elevator mechanism. It is also necessary to disregard all of the numeric indicia except those above which the last ball in each chute appears. These clocks are generally supplied in kit form and are relatively expensive. Some features of the ball clock are described in U.S. Pat. No. 4,077,198.

Another device, somewhat related to my present invention although it is not within the field of novelty clocks at all, is a counting device, intended as a children's toy, marketed in Japan. This device has no motor, it being driven not on a time-related basis but rather by a hand crank operated by the user whenever the user desires. When the crank is operated, a disc-shaped counting token is carried by a belt system from a bottom container to top of the device, where the token falls into one of three straight vertical chutes. The first (rightmost) chute which is reached represents units ("ones"), the second (center) chute represents tens, and the third (leftmost) chute represents hundreds. Tokens delivered to the first chute fall into that chute unless that chute is full, in which case the tokens cannot fall into that first chute and so continue to be carried by the belt system across the top of the device to the next chute. In so passing they trip a mechanism which discharges the tokens from the first chute into the bottom container—essentially resetting the "units" column to zero. There is no provision for displaying a zero in any of the columns, however, so it is necessary to infer a zero in the tens or units column when reading the counter, and this can be confusing to a child user.

Similarly, tokens that pass the first chute fall into the second chute (the tens chute), unless that chute is full, in which case the tokens continue across the top of the device (discharging the tokens from the tens chute) to the hundreds chute. The latter chute is not an accumulator, but simply a return path to the bottom container; however, passage of a token through the hundreds chute actuates the device to wave a sign indicating that the count of one hundred has been reached.

This device has a transparent front panel on which are carried numeric indicia that are the same color as the back surfaces of the straight vertical chutes, while the counting tokens are a contrasting color; thus the indicia tend to blend visually into the background of the device except when tokens are accumulated in the chutes, making the indicia stand out against the contrasting tokens.

Because it is convenient to use circular tokens (to minimize the likelihood of the tokens' jamming at various points in the mechanism during operation), and because it is desirable to use tokens that have a certain minimum dimension in at least one direction (to provide a fairly substantial visual impact), the overall height of a device such as the Japanese counting toy must be at least a certain number of times that minimum dimension (that is, the diameter of each circular token). In the modern toy market that fact assumes significance in that it controls the amount of material that must be used, the amount of storage and display space required, and so forth. It is partially in response to such considerations that the ball clock discussed earlier is supplied as a kit; but this distribution approach in turn poses the disadvantage that user assembly is required, and even so the packaging for the unassembled kit is quite bulky.

My invention is directed to the provision of a clock mechanism that operates with counting tokens but in which the user need not (1) disregard numeric indicia for later times than the particular token pattern accumulated at any moment, (2) infer zeroes, (3) perform mental arithmetic or mental inversion of numeric indicia to determine the time, or (4) estimate the number of seconds elapsed since the last token came to rest. My invention is further directed to provision of a clock mechanism that is relatively compact and so relatively inexpensive in terms of materials, packaging, shipment, storage and display.

Primarily, however, my invention is directed to provision of a clock mechanism that presents an entirely new, unique, and captivating visual effect.

SUMMARY OF THE DISCLOSURE

The preferred embodiments of my invention that are herein disclosed provide a clock mechanism for use with counting tokens. The mechanism includes means for defining three generally vertical but zigzag-shaped channels that are adapted to guide and hold visible accumulations of such tokens. These channel-defining means advantageously consist of a formed rear case that defines the rear and side walls of the channels and a generally transparent front case through which can be viewed the channels and any tokens accumulated in the channels.

The zigzag shape of each channel permits the stack of tokens to be substantially compressed vertically, relative to a straight channel, so that the overall height of the mechanism is very considerably reduced—thereby providing the benefits of compactness already mentioned. In addition the zigzag shape of each channel provides a more interesting visual effect when the tokens are accumulated in the channels, and a much more impressive dynamic visual impact when the tokens are—as will be described below—released. The zigzag shape has yet another advantage in that the tokens when falling into the channels are limited in their falling speed, thereby reducing the necessary strength of the retaining-and-release mechanisms that must be provided to controllably support and then release the columns of tokens; this reduction in mechanism strength also has significant beneficial effects upon overall cost of manufacture in volume.

Finally, the zigzag shape permits and facilitates retention of one token in each of the channels, when the tokens are released, without disturbing the natural-appearing pattern of tokens in the channels when they are full of accumulated tokens. The retention of one token in certain of the channels in turn obviates the need for the user to infer zeroes in those channels—the "minutes" and "ten-minutes" channels.

The mechanism also includes time indicia that are associated with and in front of each of the channels. Each of the indicia is adapted to be generally inconspicuous when no token is behind it, but adapted to be relatively conspicuous when a token is held behind it in the associated channel. This feature makes it unnecessary for the user to disregard those indicia that correspond to later times than represented by the particular token pattern accumulated at any moment, and so simplifies the reading of the clock. This feature is particularly advantageous for child users.

The channels, as suggested above, have hour, ten-minute (rather than five-minute, as with the ball clock), and minute implications. This makes it unnecessary to perform mental arithmetic to determine the time. The hour channel is at the left and the minute channel at the right, making it unnecessary to invert the order of the indicia to obtain a customary time format.

The mechanism also includes synchronously driven apparatus for delivering the tokens from a bottom collecting enclosure to the tops of the channels. This delivering mechanism operates at a substantially constant rate. The path of tokens in the delivery mechanism is fully visible, and additional indicia are provided in front of this delivery path. Like the indicia previously mentioned, these indicia in front of the delivery path are made relatively conspicuous by positioning of tokens behind them; thus they seem to appear and disappear as the tokens pass along the delivery path behind them. These indicia indicate the number of seconds that has elapsed since delivery of the last previous token to the top of the minute channel, making it unnecessary to estimate seconds in reading the clock.

All of the indicia are carried on a generally transparent front case that is affixed to the front of the rear case. The front case also forms the front walls of the channels and the delivery path, thereby constraining the tokens within the channels and path, and within the apparatus.

The clock mechanism also includes means for causing delivered tokens to bypass each particular channel when that channel has accumulated a respective specified number of such tokens. This bypass-causing means simply consists of forming and continuing the delivery path across the tops of the channels just above the top of the uppermost token position in each channel. Consequently when a particular channel is full, the next token delivered rides across the top of the previously delivered token, the top one in the particular channel, and continues along the continuation of the delivery path.

The clock mechanism also includes means responsive to a token that has bypassed a particular channel to release from that channel tokens that are accumulated therein. The release mechanism does not, however, release all of the tokens accumulated in the channel whose contents are to be discharged. In each channel the lowermost token always remains in place; in the minute and ten-minute channels these tokens are identified by the associated indicia as "zero" tokens, and in the hour channel the lowermost token is identified as the "one-o'clock" token.

In operation the delivery apparatus moves tokens one per minute from the area of the bottom enclosure, up the right side of the clock face along the delivery path previously mentioned (and thus behind the seconds indicia), and into position above the right-hand (minutes) channel. If that channel is not full, a delivered token falls into that channel; when the minutes channel is full, the delivered token proceeds across the top of the clock face—releasing the previously accumulated tokens in the minutes channel, with the exception of the zero token—into position above the center (ten-minute) channel.

Similarly, if that channel is not full, the delivered token falls into it; when the ten-minute channel is full, the delivered token rides across the top of the topmost token in that channel and proceeds further across the upper portion of the clock face—releasing the previously accumulated tokens in the ten-minute channel (except for the zero token at the bottom of that channel-)—into position above the left-hand (hours) channel.

The tokens delivered to the hours channel likewise fall into it until it is full. The next delivered token rides across the top of the uppermost token in the full hours channel, proceeds yet further across the upper portion of the clock face—releasing the previously accumulated tokens (except for the one-o'clock token) in that channel. This last token then falls through a return path to the containing enclosure at the bottom of the clock mechanism.

To enhance the visual impact of the clock mechanism operation I prefer to include also a dynamic feed means for transfering such tokens from the bottom enclosure to the delivering apparatus. As will be seen, this dynamic feed means is not necessary to operation of the clock, since the delivering apparatus itself is readily made capable of picking up only one token at a time, at proper intervals, but the dynamic feed means adds an additional element of dynamism to the overall visual effect provided by the clock operation. In my preferred embodiment herein disclosed the dynamic feed means consists of a sectored wheel into which one token at a time can roll from the bottom enclosure. The sectored wheel rotates, carrying the tokens around a short arcuate path from the bottom enclosure into the initial portion of the delivery path—just in time to rendezvous with the next active delivery element of the delivering apparatus.

The delivering apparatus itself includes a time-regulated prime mover that is operably fixed with respect to the channel-defining means mentioned earlier. The prime mover may be a synchronous electric motor operated from the "house power" line, or an electronically regulated electric motor operated from a dedicated power supply (i.e., dry cells to be installed in the clock mechanism by the user), or from wind-up clockwork. The delivering apparatus also advantageously includes a gear train, likewise operably fixed with respect to the channel-defining means, and driven by the prime mover. The gear train provides a mechanical advantage, which is to say, it provides a speed step-down. In the instance of a wind-up prime mover, the gear train may be in part, as is conventional, an intermediate stage between the wind-up spring and the balance-wheel-and-ratchet time-regulating stages of the clockwork; but for purposes of the disclosure and claims herein it will be understood that the gear train and time regulation features are identifiably separate elements.

The delivering apparatus also includes a toothed drive sprocket, driven from the gear train, and a plurality of idler sprockets. All of the sprockets are rotatably fixed with respect to the channel-defining means, and the idlers are advantageously disposed in association with the delivery path near the corners of the path. The delivering apparatus also includes an endless belt that is adapted and disposed to be driven by the drive sprocket and guided by the idler sprockets along an endless path that passes below the bottom enclosure (and is suitably disposed relative to the dynamic feed mechanism), up the right side of the clock face and across the top of the clock face above the vertical zigzag channels. The belt path also proceeds down the left side of the clock mechanism, to return to the area of the bottom enclosure.

The corner-positioned idler sprockets guide the belt around the corners of the delivery path, thus preventing rubbing and wear of the belt against other parts of the mechanism that would otherwise occur.

A plurality of pins, herein denominated "pushpins," is carried on and spaced apart along the belt at such distances as to pass any given point along the path at one-minute intervals, when the apparatus operates at its nominal design speed. Each pushpin is adapted to push one token at a time along the delivery path to positions above the channels, as previously described.

The clock mechanism is advantageously adapted for use with tokens that are generally disc-shaped. Such tokens are preferable to spherical tokens in that the fore-to-aft depth of the channels can be very substantially reduced, thereby again improving compactness and cost of manufacture, shipping, storage and display. In addition, the material used in the tokens themselves is minimized in using disc-shaped tokens relative to spherical ones. For enhanced visual effect I prefer to form each token with a recess to receive and carry a coin. The clock thus operates to display the time by the patterns of the coins carried in the generally disc-shaped but recess-formed tokens.

I consider my invention to reside in the provision of an apparatus as herein described that is adapted for use with suitable tokens whether the tokens are supplied separately or are supplied in combination with the apparatus.

All of the foregoing concepts, features and advantages will be more fully understood and appreciated by reference to the following detailed description and to the appended drawings, of which:

BRIEF DESCRIPTION OF THE DRAWINGS

FIG. 13 is an elevational section of the release mechanism for the center channel of the FIG. 1 embodiment, taken (as previously mentioned) along the line 13—13 of FIG. 1.

FIGS. 15 and 17 are elevational section views directly comparable to FIG. 13, while FIG. 16 is a perspective view taken from above and to the rear of the rear case.

DETAILED DESCRIPTION OF THE PREFERRED EMBODIMENTS

Figure 1:
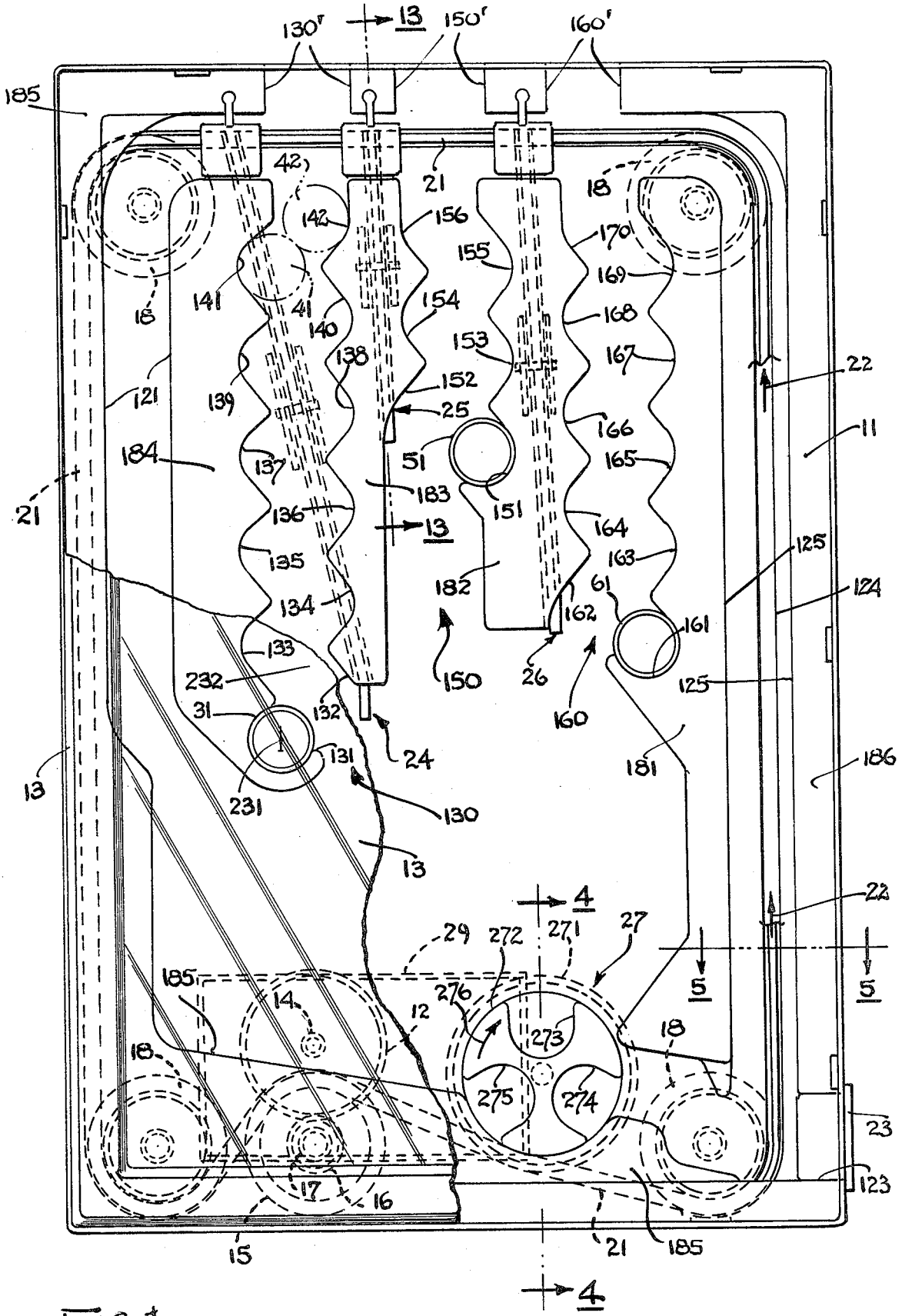
FIG. 1 is an elevation view of the face of the clock mechanism of a preferred embodiment of my invention, partly cut away (as to the forward case and the belt), and partly in phantom (as to certain components behind the rear case).

As the configuration and operation of the preferred embodiment have already been described rather completely, it only remains for this detailed description to identify the components already discussed and to elaborate upon a few additional details.

All or portions of the rear case 11 appear in FIGS. 1 through 7 and 13 through 17. The rear case 11 is a unitary formed element, advantageously made as a single piece of molded plastic with all of the necessary recesses including channels 130, 150 and 160, delivery path 125, belt groove 124, and forwardly projected surfaces 181, 182, 183, 184, 185 and 186 separating the recessed portions. Also formed in the rear case is an outlet port 123, to be fitted with hatch 23, for removing all of the tokens so as to permit resetting the clock to a desired time; and inlet passages defined at 130', 150' and 160' for reinserting the tokens in appropriate channels to obtain the desired (current) reset time.

The hour channel 130, like the other channels, is formed in a zigzag pattern, but other patterns of plural lateral deviation are within the scope of my invention. The lowermost leftward lateral deviation of channel 130 terminates with, in effect, a pocket at 131 for permanent retention of the lowermost token 31. Other tokens stack above token 31 in zigzag fashion, following the contours of the channel 130. The disposition of tokens within the three channels is indicated exemplarily by the tokens 41 and 42 shown in the phantom line near the top of channel 130; it being noteworthy that token 42 rests against the rightward deviation edge 142 of the channel 130, while token 41 rests against the leftward deviation edge 141 of the channel 130. Other tokens as may be present in the channel will respectively rest against the rightward deviation surfaces 132, 134, 136, 138 or 140, or the leftward deviation surfaces 133, 135, 137 or 139.

Except for lowermost token 31, all of such tokens as may be in channel 130 are retained therein by the lower operative tip of the release-mechanism arm 24. With token 31 in the lowermost "pocket" 131 of channel 130 (as is always the situation with that particular token), the corresponding indicium 231 formed on transparent forward case 13 is highlighted by color and/or other contrast between the indicium 231 and the coin held in token 31. With no token resting against surface 132, just above and to the right of token 31, the next corresponding indicium 232 (the numeral "2") is not so highlighted, and so tends to blend into the similarly colored rear case surface 11, more particularly the rear wall of channel 130. The same will be true of the other indicia 233 through 242, shown in FIG. 2, that are associated with the hour channel 130.

As an example, if three tokens 31, 32 and 33 are present (as in FIG. 3) in channel 130, they will respectively render relatively conspicuous the corresponding indicia 231, 232 and 233 carried on the forward case 13; while the remaining indicia 234 and above will appear relatively inconspicuous. The user viewing the clock face will thus see the highest number so rendered conspicuous to be a numeral "3", and will not have to pay any attention at all to the possible significance of the higher numerals in that channel's grouping.

Figure 3:
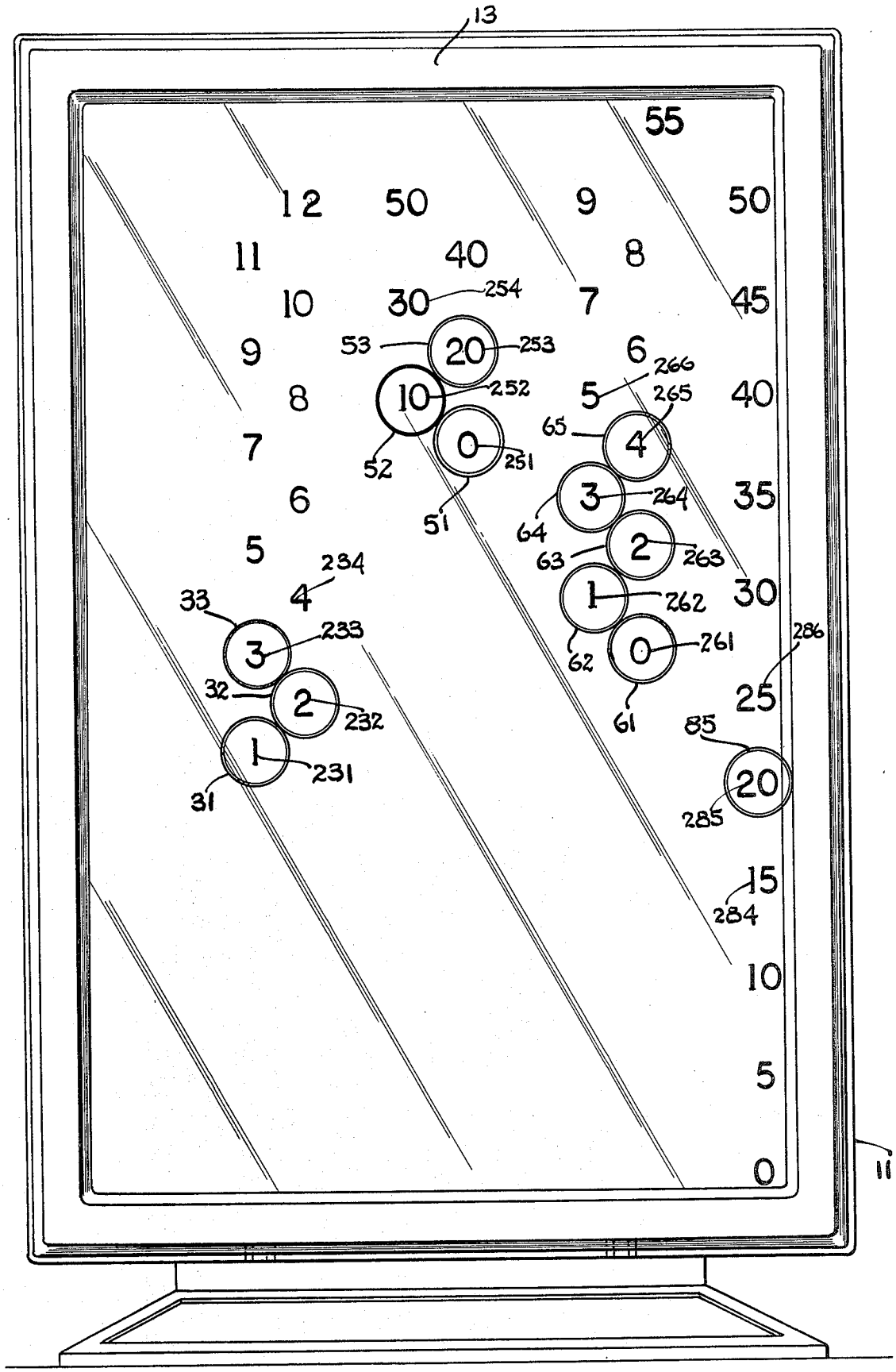
FIG. 3 is similar to FIG. 2 but also showing an exemplary combination of counting tokens in exemplary positions behind the forward case.
Figure 4:
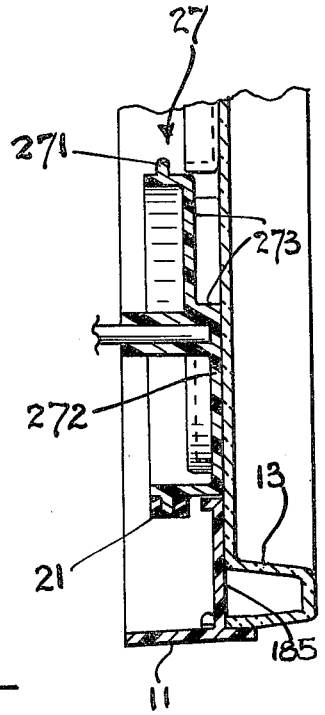
FIGS. 4, 5 and 13 are sectional elevations of the FIG. 1 embodiment, taken respectively along lines 4—4, 5—5 and 13—13 of FIG. 1.
Figure 5:
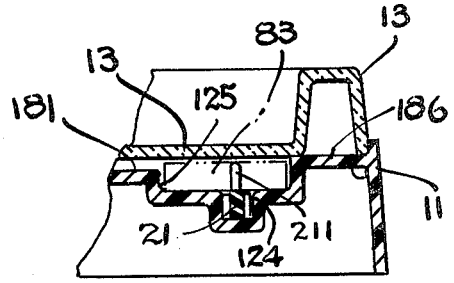

The multiple indicia 231 through 292 of FIG. 3 that are carried on the forward case 13 may be applied thereto by any of a great variety of techniques, including stamping, hot foil stamping, silkscreening, or decals. The indicia may also be molded into the surface of the case 13, and if desired the molded-in indicia may then be further emphasized by stamping, hot foil stamping, silkscreening or decals. Another alternative would be, in principle, etching—but this possibility appears inappropriate for a variety of practical reasons.

The indicia 231 through 292 should all be made to contrast, by color and/or texture and in any other desired way, with the coins to be inserted into the counting tokens, if any are to be inserted, or to contrast with the tokens themselves if coins are not to be inserted. The indicia should also be made to not so contrast with the background color and/or texture, etc., which is to say the appearance of the rear case. This is of course a condition on the color, texture, etc. of the rear case: it must contrast with the coins or (if coins are not to be used) tokens.

Figure 2:
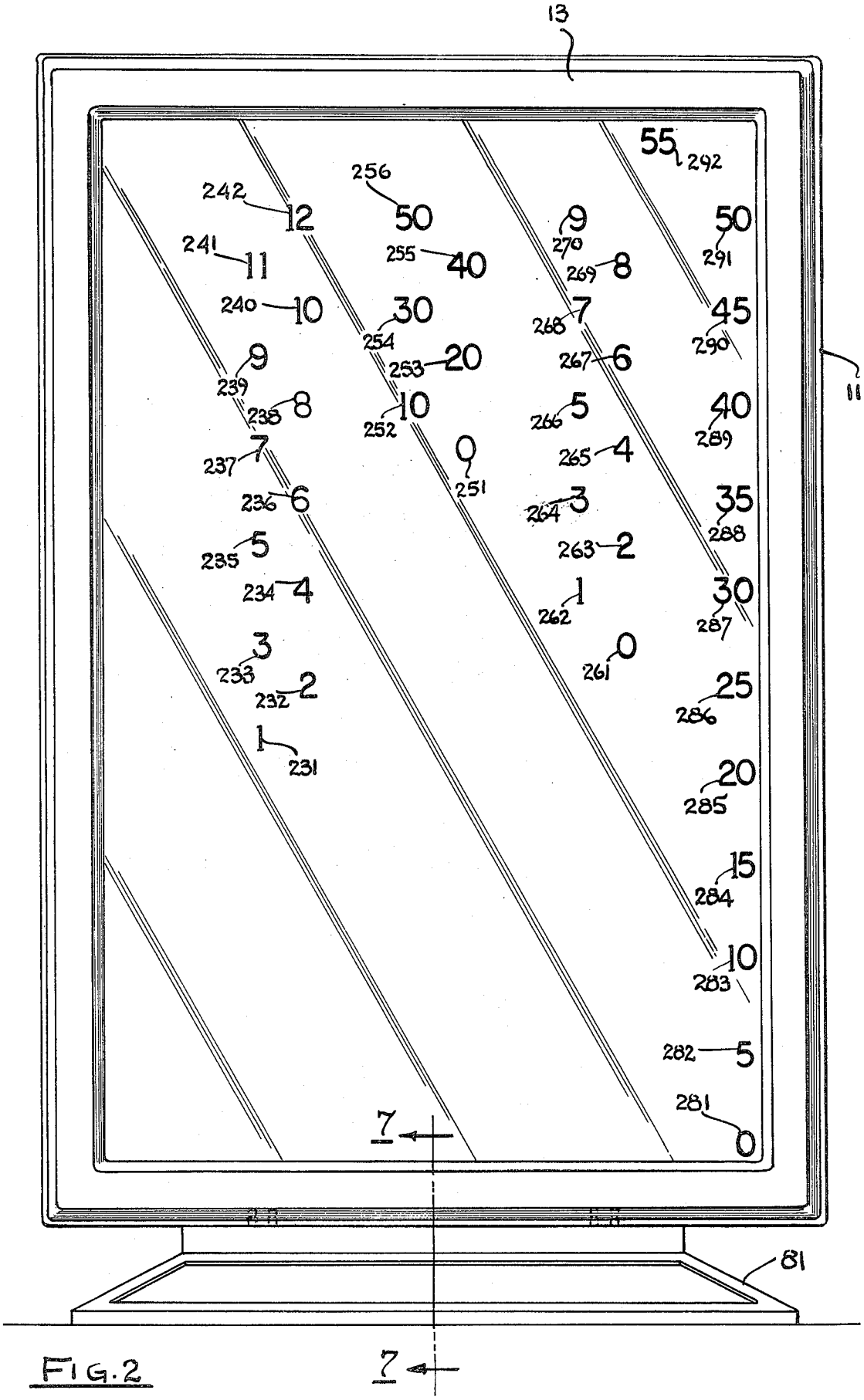
FIG. 2 is an elevation of the forward case of the FIG. 1 embodiment, also showing a stand for the mechanism.

Similarly the ten-minute channel 150 has permanently retained lower token 51 in "pocket" 151 formed as the lowermost rightward deviation of the channel, remaining tokens when present being stacked above token 51 in leftward deviations 152, 154 and 156 and rightward deviations 153 and 155, and held in place by the lower tip of release-mechanism arm 25. Associated with permanently retained token 51 in pocket 151 is indicium 251 (FIGS. 2 and 3), which is a numeral zero, "0"—which is always highlighted because of the constant presence of token 51; not so as to other tokens that may or may not be present in the corresponding upper deviations 152 through 156, behind respective indicia 252 through 256 (FIGS. 2 and 3). The exemplary accumulation of tokens shown in FIG. 3 includes a token 52 in deviation 152 (FIG. 1) behind indicium 252 (numerals "10" as shown in FIGS. 2 and 3), and a token 53 in deviation 153 (FIG. 1) behind indicium 253 (numerals "2O" as shown in FIGS. 2 and 3). Thus the highest indicium made conspicuous by contrasting color and/or other means of a coin in a counting token would be the numerals "20"—all higher indicia tending to blend into the background.

Likewise the minute channel 160 has permanently retained lower token 61 in "pocket" 161 formed as the lowermost rightward deviation of the channel, remaining tokens when present being stacked above token 61 in leftward deviations 162, 164, 166, 168 and 170 and rightward deviations 163, 165, 167 and 169, and held in place by the lower tip of release-mechanism arm 26. Associated with permanently retained token 61 in pocket 161 is indicium 261 (FIGS. 2 and 3), which is a numeral zero—and which is always highlighted because of the constant presence of token 61. The exemplary accumulation of tokens in FIG. 3 includes tokens 62, 63, 64 and 65 in respective deviation positions 162, 163, 164 and 165, behind respective indicia 262, 263, 264 and 265. Thus the highest indicium made conspicuous by contrast with a coin in a counting token would be the indicium 265, a numeral "4"—indicium 266 and all higher indicia tending to blend into the background.

Operatively secured behind the rear case are a motor housing 29; a commercial clock-motor/gearbox unit (not shown) within the housing, the output drive shaft 14 of the motor/gearbox operating at one rotation per minute and having mounted upon it a drive gear 12; a driven gear 16 mounted for rotation about shaft 17 and integral with the gear 16 a toothed sprocket 15. The motor/gearbox output shaft speed is thus further stepped down by the gear train consisting of gears 12 and 16, and this gear train drives the sprocket 15. The latter in turn drives the belt 21, which is provided with mating sprocket holes and which runs in groove 124, being guided by the drive sprocket 15 and the four idler sprockets 18. Also rotatably secured behind the rear case 11 is a freewheeling sprocket 271, which engages and is driven by the belt 21. The sprocket 271 is an integral part of the dynamic feed mechanism mentioned earlier; this mechanism also includes the sectored wheel 272, with recessed sectors 273, 274 and 275 that pick up tokens in the bottom enclosure formed above forwardly projected surface 185, near the bottom of the clock face, and feed those tokens one at a time to the bottom end of the delivery path 125 for pickup by the pushpins on the belt 21. The sprocket 271 and sectored wheel 272 are advantageously formed as a single unit, as illustrated in section in FIG. 4, and rotate together on a common shaft fixed to an extension of the motor housing 29, behind the rear case.

Once in the bottom of the delivery path 125, a token is pushed upward in that path by the next arriving pushpin 211 (FIG. 5) extending forwardly from belt 21, which moves in the direction indicated by arrow 22 (FIG. 1) in belt groove 124.

Each token thus passes upward behind the series of indicia 281 through 292 (FIG. 2), the contrast between token (or coin) and indicia producing the visual effect of flashing the successive indicia 281 through 292 in sequence as the token progresses upward along the path 125. In the exemplary condition of the mechanism illustrated in FIG. 3, a token 85 is in the delivery path and has ascended to a position behind the indicium 285, which consists of the numerals "20". This example thus indicates that twenty seconds have elapsed since the last previous token was delivered to the top of the "minute" channel 160.

Considering all of the tokens exemplarily shown in FIG. 3, and previously discussed, the clock as shown in that drawing is displaying the time 3:24 and 20 seconds, 3:24:20.

Figure 10:
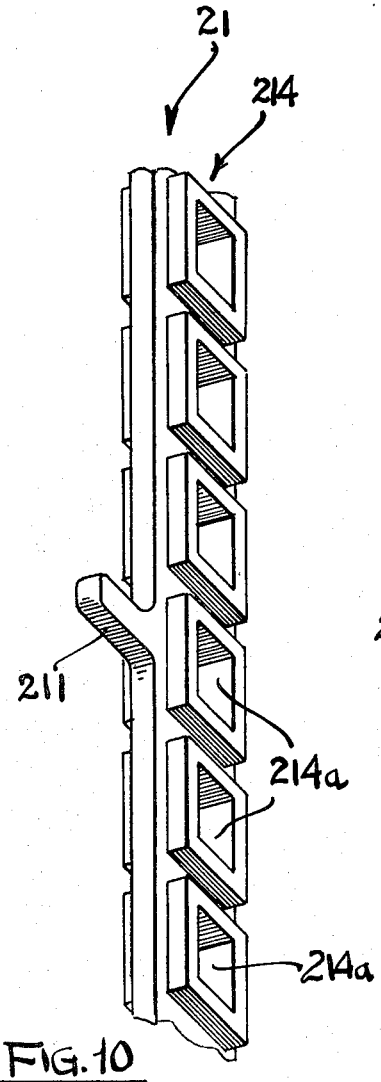
FIGS. 10 through 12 are respectively perspective, exploded perspective, and longitudinal section views of the delivery-system belt used in the embodiment of the other figures.

The belt 21 is made up of three identical sections, each having one extended pushpin 211, the three identical sections being adapted to be linked together at their ends to form an endless single belt. FIG. 10 shows the typical portion of the belt 21 at the point where pushpin 211 is formed at the side of the belt. Also shown of course are typical sprocket holes 214*a* of this particular exemplary section 214 of the belt 21.

Figure 11:
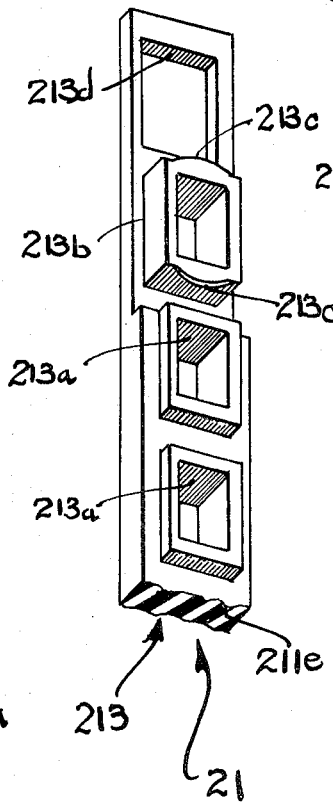
Figure 12:
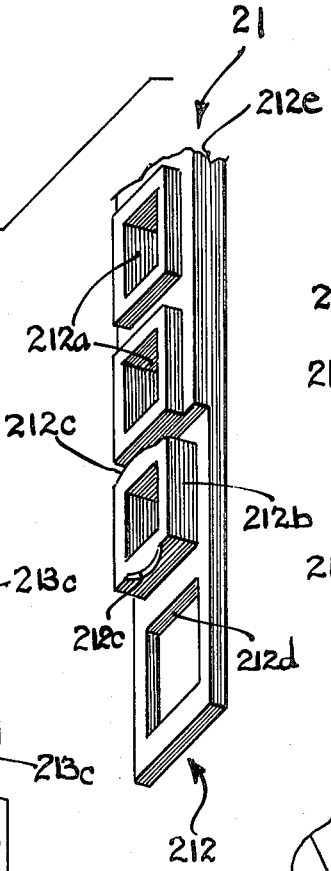
Figure 12:
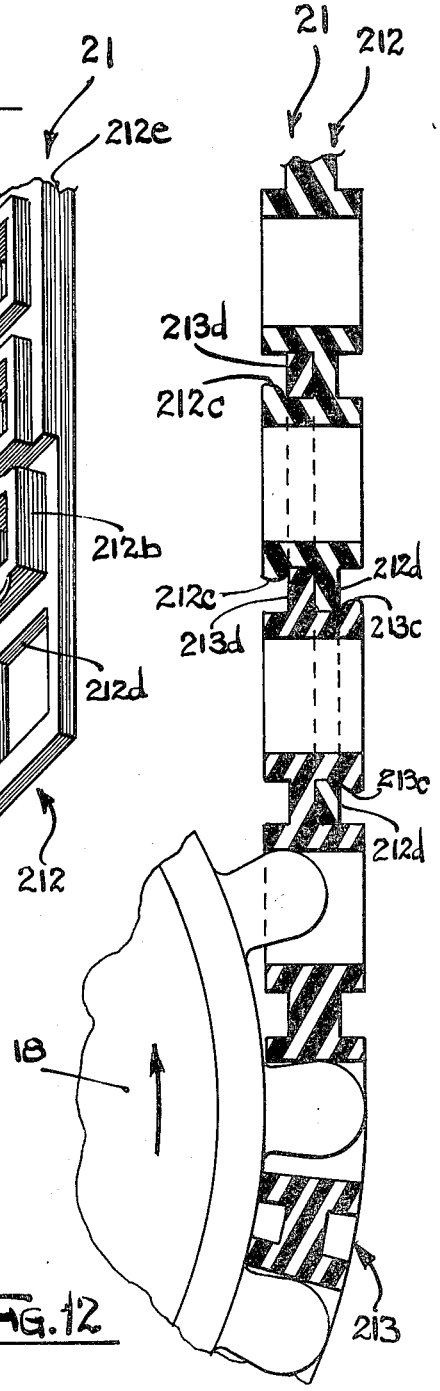
Figure 13:
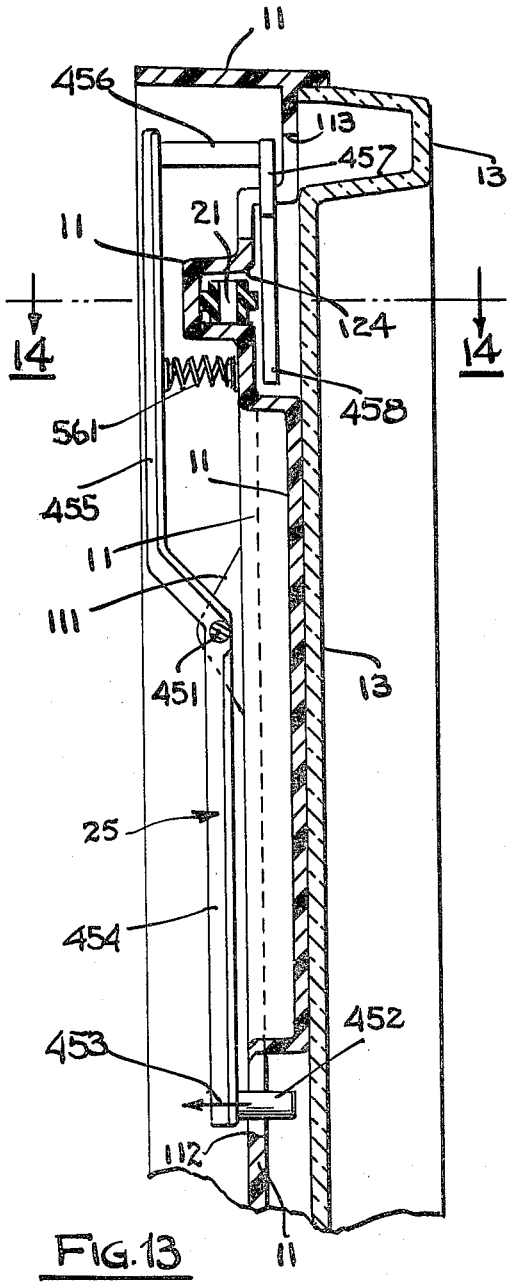

FIG. 11 shows the preferred means of linking two adjacent sections 212 and 213 of the belt 21. Belt sections 212 and 213 have identical sprocket holes 212*a* and 213*a* respectively, identical female links 212*d* and 213*d* respectively, and mating identical male links 212*b* and 213*b* respectively. The male links are provided with retaining lips or extensions 212*c* and 213*c* respectively. Thus the two sections 212 and 213 are assembled simply by aligning the respective male and female links and snapping them together so that the retaining extensions are on the respective "far sides" of the female links, as shown in FIG. 12.

Figure 6:
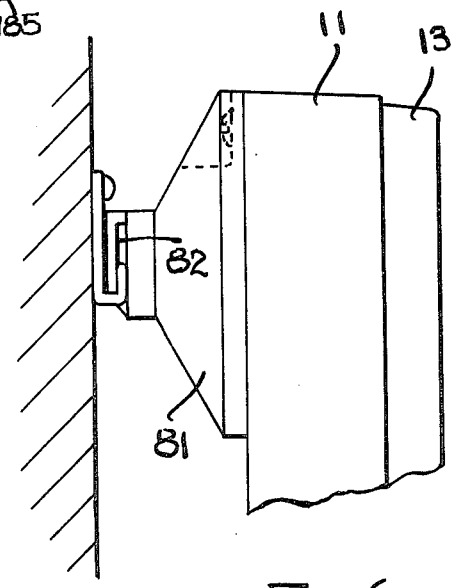
FIGS. 6 and 7 are elevations, partly in section, showing use of the FIG. 2 stand respectively as a wall-hanging fixture (FIG. 6) and as a stand (FIG. 7, taken along the lines 7—7 in FIG. 2).
Figure 7:
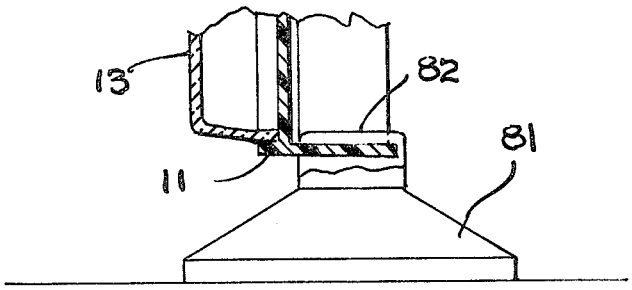
Figure 8:
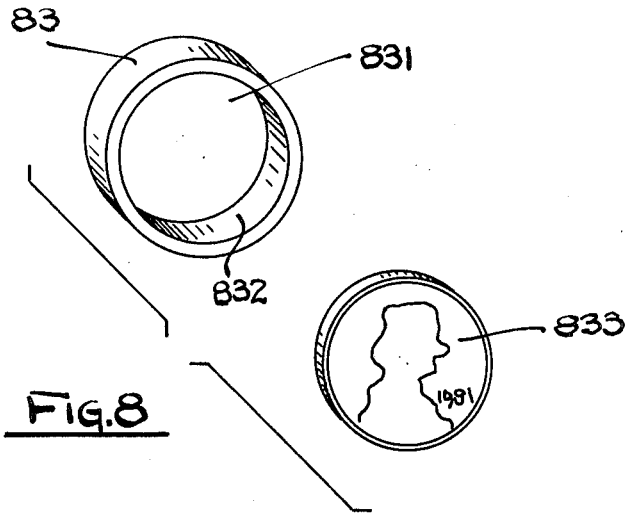
FIGS. 8 and 9 are respectively perspective and sectional views of a counting token suitable for use in the embodiment of the other figures, and particularly showing the carrying of a coin in the token.
Figure 9:
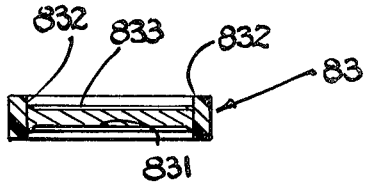

FIGS. 6 and 7 simply illustrate how the "base" provided can be used to either stand the clock mechanism on a table or like horizontal surface (FIG. 7), or aid in hanging the clock mechanism from a wall or like vertical surface (FIG. 6).

A variety of release mechanisms 24, 25, 26 (FIG. 1) may be used with the clock mechanism of my invention, depending upon details of materials used, weights of the tokens and carried coins if any, and in particular the desired reliability and design life of the apparatus. As the only part of the clock that operates only intermittently and the only part that has a reciprocating action, the release mechanism is in fact the primary determinant of the reliability and design-life parameters for the whole clock. A moderate or middle-of-the road approach to the release-mechanism requirements appears in FIGS. 13 and 14.

Figure 14:
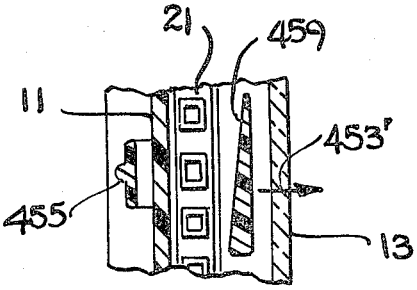
FIG. 14 is a complementary plan section of the same mechanism, taken along the line 14—14 of FIG. 13.

The device shown in those two figures, using the release mechanism 25 for the ten-minute channel 150 as exemplary of all three release mechanisms 24, 25 and 26, includes a lever having upper arm 455 and lower arm 454, pivoted about an axle 451 that is supported from rearward extension 111 of the rear case 11. The upper arm 455 is spring-loaded rearward at 561, and supports an integral forward extension 456 and a follower 457. The follower 457 terminates in a very shallowly beveled follower surface 459 (FIG. 14). Tokens pushed along the portion of the delivery path which traverses the top of the clock face act as cams, engaging the beveled follower surface 459 and thus camming the follower surface forward (in the direction indicated by arrow 453' of FIG. 14). The entire follower 457, forward extension 456, and upper lever arm 455 under the camming action of a token swing forward, of course swinging the lower lever arm 454 and its attached token-retainer pin 452 rearward (in the direction indicated by the arrow 453 of FIG. 13). Consequently while the token pulls the upper portion of the double lever arm forward into the upper hole 113 in the rear case 11, the token-retainer pin 452 retracts into the lower hole 112 in the rear case 11; this retraction allows tokens accumulated in channel 150 (FIG. 1) to fall from that channel into the bottom enclosure area as previously mentioned.

While this alternative form of the release mechanism is moderately reliable and moderately inexpensive, the thin, shallowly tapered follower portion may with heavy usage be subject to distortion with resultant tendency to bind, or possibly with a tendency to deform and no longer pull the upper lever arm forward. It is also possible, with this single-action design, that the first token into a given channel (after the permanently retained token in that channel) may strike the retainer pin 452 with enough force to knock it out of the way, thus allowing that token (and perhaps all subsequent ones) to avoid becoming part of the accumulation intended—and thus throwing off the time indication. Even so, the need for a pivotal support at 451 and a spring at 561 (or integral equivalent), along with a slightly tricky assembly operation, make this embodiment of the release mechanism more expensive than might be desired.

Figure 15:
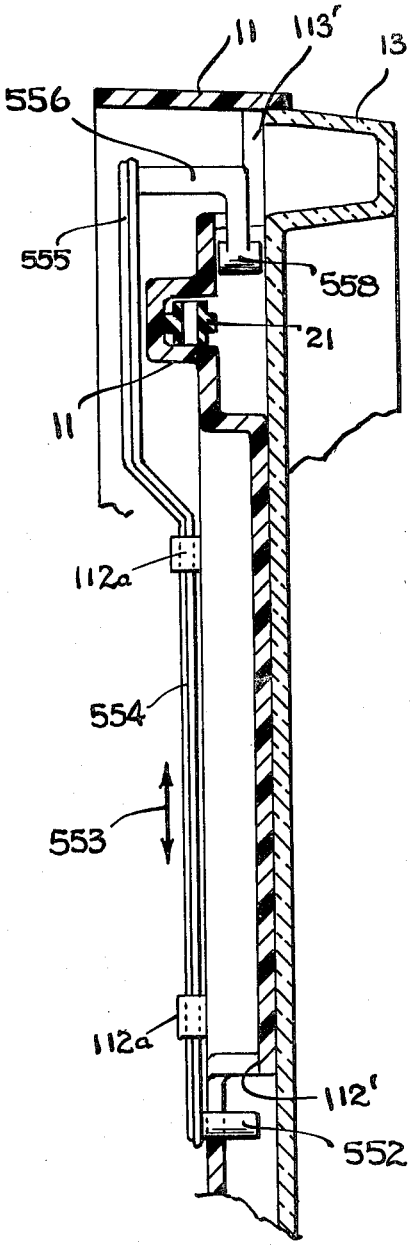
FIGS. 15 through 17 are views of alternative release mechanisms that may be substituted for the release mechanism of FIGS. 13 and 14, with appropriate minor modifications to the rear case as illustrated. In particular.

Taking next the option of an embodiment aimed at provision of a very inexpensive toy with expectably limited life, FIG. 15 shows an alternative release mechanism that slides vertically, along the directions indicated by arrows 553. The sliding motion of the lower pushrod 554 is constrained by guides 112*a* and of course provides vertical motion of the upper pushrod section 555 and the forward extension 556 and follower 558 (in slot 113', formed in the upper edge of the rear case 11) as well, and similar vertical motion of the token-retaining pin 552 in the lower slot 112'; this motion is produced by engagement of a token (pushed by pushpins of the belt 21) with a beveled undersurface of follower 558. In this embodiment the retainer pin 552 retracts upward into the forwardly projected "island" 183 (FIG. 1), rather than rearward as in FIGS. 13 and 14. The tendency toward binding of this sliding-action release mechanism is probably worse than that of the FIGS. 13 and 14 mechanism; the sliding pushrod may bind in such a way as to either not be cammed upward by the token or not fall back down into place after the token has passed on.

Figure 16:
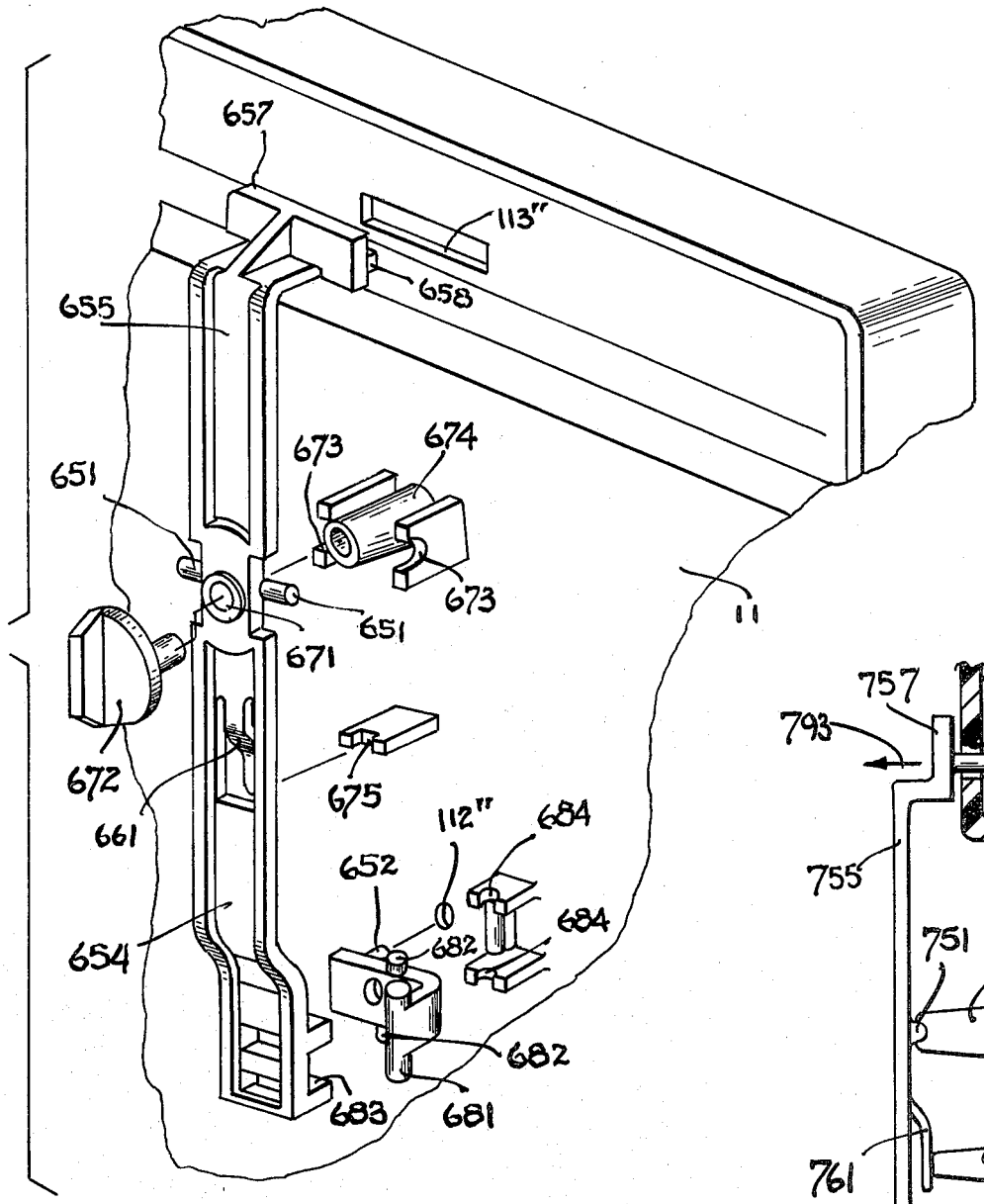

Turning to the option of an embodiment aimed at provision of a relatively more expensive toy with expectably very good reliability and long life, FIG. 16 shows a two-stage or compound-action release mechanism which is sturdy, positive-acting, and so designed as to resist being knocked aside by the first token to fall into a particular channel; it is also very unlikely to be subject to binding. This mechanism uses two double-arm levers.

The larger of the two is secured by fastener 672 to threaded pillar 674, but not immovably; the fastener 672 and pillar 674 hold the integral pivot rods 651 of the lever into pivot yoke surfaces 673. The lower lever arm 654 is spring-loaded rearward by integral spring 661, so that the upper arm 655 is urged forward. Consequently the reinforced follower flange 657 is swung forward against the outer back surface of the rear case 11, and the projecting follower surface 658, which extends forwardly from the flange 657, is made to protrude through the hole 113" in the rear case 11. This follower 658 protrudes forward through the hole 113" into the path (not shown in FIG. 16) of the traveling tokens.

When a token engages the beveled follower surface 658, it of course forces the upper arm 655 rearward and the lower arm 654 forward. The polarity of this motion is reversed, however, by the action of the second, smaller lever 681–682–652. The integral pivot rods 682 of this second lever are held in engagement with pivot yoke surfaces 684 formed in rearward extensions from the rear case 11, with the actuated end shape 681 adapted to reliably engage the actuating end shape 683 of the lower arm 654 of the larger lever. The token-retainer pin 652 normally protrudes through a hole 112" formed in the rear case 11. Thus the camming action of a token against the follower surface 658 forces the actuated end 681 of the small lever forward, and retracts the token-retainer pin 652 rearwardly through hole 112". Since the only possible action of the smaller lever is about a substantially vertical axis established by pivots 682 and yoke 684, the likelihood of a falling token improperly pushing the release mechanism out of the way is slight.

Figure 17:
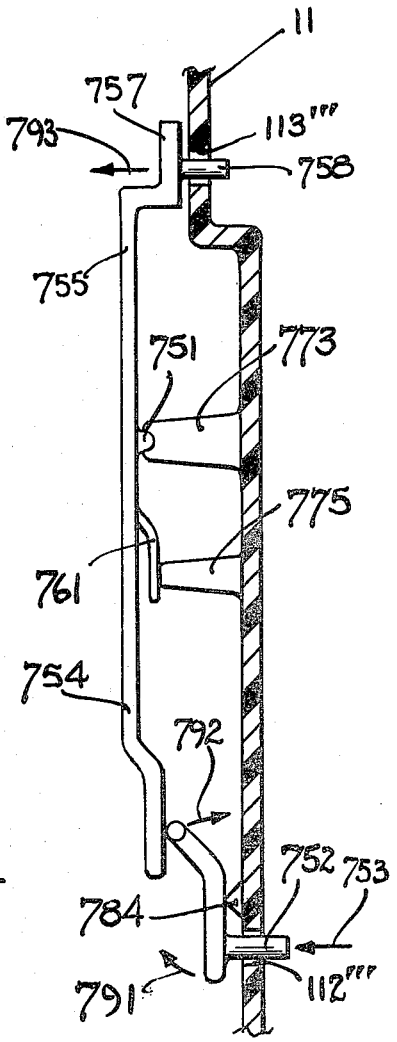

The embodiment of FIG. 17 is similar to that of FIG. 16 in that it is positive-acting—that is to say, pushing action by a token on beveled follower surface 758 will push the upper end of the lower lever forward as indicated by the direction of arrow 792, and the token-retainer pin 752 is positively retracted as shown by the directions of arrows 753 and 791. In this mechanism, however, unlike that of FIG. 16, both levers rotate about horizontal axes, so the mechanism does not have the inherent resistance to disturbance by a falling token that may be expected from the FIG. 16 apparatus. Yet the mechanism of FIG. 17 can probably be designed to minimize that problem, and it will be recalled that one of the advantages of the zigzag pattern of the generally vertical channels 130, 150 and 160 (FIG. 1) is that such a pattern tends to minimize the impact of the first token into a particular channel upon the token-retainer pin in that channel.

It will be understood that all of the foregoing details of form and function are intended only as exemplary of preferred embodiments of my invention, whose scope is to be determined by reference to the appended claims.

I claim:

1. A clock mechanism for use with counting tokens and comprising:

means defining generally vertically disposed channels adapted to guide and hold visible accumulations of such tokens;

time indicia associated with and in front of the channels, each indicium adapted to be generally inconspicuous when no such token is behind it, and each indicium adapted to be made conspicuous by such a token held behind it in the associated channel; and synchronously driven apparatus for delivering such tokens to the channels, at a substantially constant rate, for accumulation therein.

2. The clock mechanism of claim 1, also comprising:

means for causing delivered tokens to bypass each particular channel when that channel has accumulated a respective specified number of such tokens; and means responsive to such a token that has bypassed a particular channel to release from that channel tokens accumulated therein.

3. The clock mechanism of claim 1, also comprising:

means defining an enclosure for containing such tokens;

dynamic feed means for transfering such tokens from the enclosure to the delivering apparatus.

4. The clock mechanism of claim 2, also comprising:

means defining an enclosure for receiving such tokens released from a channel and for containing such tokens; and dynamic feed means for transfering such tokens from the enclosure to the delivering apparatus.

5. The clock mechanism of claim 1, adapted for use with such tokens that are generally disc-shaped.

6. The mechanism of claim 5, adapted for use with such tokens each of which is formed to receive and carry a coin.

7. The clock mechanism of claim 1, also comprising:

a delivery path, for such tokens, defined by the delivering apparatus;

further time indicia associated with the delivery path, each of said further indicia being generally inconspicuous when no such token is behind it in the delivery path and each of said further indicia being made conspicuous when a token is behind it in the delivery path.

8. The clock mechanism of claim 1, wherein the delivering apparatus comprises:

a time-regulated prime mover operably fixed with respect to the channel-defining means;

a gear train likewise operably fixed with respect to the channel-defining means and driven by the prime mover, and providing a mechanical advantage;

a toothed drive sprocket, driven from the gear train, and a plurality of idler sprockets, all the sprockets being rotatably fixed with respect to the channel-defining means;

an endless belt adapted and disposed to be driven by the drive sprocket and guided by the idler sprockets along an endless path that passes above the channels; and a plurality of pushpins carried on and spaced apart along the belt, each adapted to push one such token at a time along the path to positions above the channels.

9. The mechanism of any one of claims 1 through 8, in combination with a plurality of such tokens.

10. The clock mechanism of any one of claims 1 through 8, wherein each generally vertical chute is formed with a plurality of lateral deviations.

11. The clock mechanism of claim 10, in combination with a plurality of such tokens.

12. The mechanism of claim 10 wherein each generally vertical channel is formed in a generally zigzag path.

13. The mechanism of claim 12 wherein substantially each lateral deviation accommodates one of such tokens.

14. The clock mechanism of claim 13, in combination with a plurality of such tokens.

15. The clock mechanism of any one of claims 1 through 8, wherein:

the channel-defining means comprise:

a formed rear case having rearwardly recessed surfaces that provide rearward walls of the said channels, forwardly projected nonrecessed surfaces in certain areas between the channels, and fore-to-aft surfaces that connect the recessed surfaces with the projected surfaces and that provide the side walls of the channels; and a generally transparent forward case, secured in front of the rear case, that provides the forward walls of the said channels; and the indicia are carried on the forward case.

16. A clock mechanism for use with generally disc- or cup-shaped counting tokens and comprising:

a rear case that is formed to define:

the rear and side walls of three generally vertical but zigzag-shaped channels adapted to guide and hold visible accumulations of such tokens;

the rear and side walls of an enclosure below the channels for holding most of such tokens when they are not in the channels; and the rear and side walls of a delivery path for passage of such tokens from the enclosure upward to drop into the channels, the delivery path extending past the channels to permit such tokens to bypass each particular channel when that channel has accumulated a respective number of such tokens;

synchronously driven apparatus for delivering such tokens to the channels, at a substantially constant rate, for accumulation therein, comprising:

a time-regulated prime mover operably secured to the rear case;

a gear train operably secured to the rear case and driven by the prime mover;

a toothed drive sprocket, driven from the gear train, and a plurality of idler sprockets disposed in association with the delivery path, all the sprockets being rotatably secured to the rear case;

an endless belt adapted and disposed to be driven by the drive sprocket and guided by the idler sprockets along the said delivery path and back down to the enclosure; and a plurality of pushpins carried on and spaced apart along the belt, each adapted to push one such token at a time along the path from the enclosure to positions above the channels;

dynamic feed means operatively mounted to the rear case in juxtaposition to the enclosure for transfering such tokens from the enclosure to the delivering apparatus;

a generally transparent front case that defines the front walls of the channels, the enclosure, and the delivery path; and time indicia carried on the front case in positions aligned with the positions occupied by such tokens when in the channels, and in positions aligned with the delivery path, each indicium being relatively inconspicuous when no such token is behind it, and each indicium being adapted to be made relatively conspicuous by a token behind it.

17. The mechanism of claim 16, also comprising:

means for causing delivered tokens to bypass each particular channel when that channel has accumulated a respective specified number of such tokens; and means responsive to such a token that has bypassed a particular channel to release from that channel tokens accumulated therein.

18. The mechanism of claim 16 or claim 17, in combination with a plurality of such tokens.

19. The combination of claim 18, wherein the tokens are generally cup-shaped to accommodate insertion of a coin to be carried within each token so as to be visible through the front case when the tokens are inside the clock mechanism.

20. The clock mechanism of any one of claims 1 through 8, or claim 16 or claim 17, wherein:

the channels are so configured that each channel always retains one token, during operation of the mechanism.

* * * * *